United States Patent [19]

Flam

[11] 4,353,555

[45] Oct. 12, 1982

[54] DUPLICATE BRIDGE SCORING SYSTEM

[76] Inventor: Frederick H. Flam, 2160 Century Park East, Los Angeles, Calif. 90067

[21] Appl. No.: 172,569

[22] Filed: Jul. 28, 1980

[51] Int. Cl.[3] ..... A63B 71/00; A63F 9/00; A63F 1/10

[52] U.S. Cl. ..... 273/148 R; 273/151

[58] Field of Search ..... 273/148 R, 148 A, 150, 273/151, 149 P; 434/128, 129, 306, 363, 364

[56] References Cited

U.S. PATENT DOCUMENTS

| | | | |
|---|---|---|---|
| 3,001,703 | 9/1961 | Flam | 273/148 R |
| 3,044,693 | 7/1962 | Flam | 273/148 R |
| 3,212,780 | 10/1965 | Jewell | 273/148 R |
| 3,236,523 | 2/1966 | Stein | 273/151 |

*Primary Examiner*—Russell E. Adams

*Attorney, Agent, or Firm*—Flam & Flam

[57] ABSTRACT

A computer system for duplicate bridge scoring utilizes a compact data card to remain attached to a duplicate board during the session of play. The card is arranged for encoding of data round-by-round rather than by player line. The computer unscrambles the pair numbers by formula or reference, the variable number of tables for each of the sections being communicated to the computer after the session starts. The data card is made sufficiently compact by the aid of the round-by-round array; by unique type style and arrangement; by utilizing machine language for the bridge score. The machine language is arranged to comport with standard readers having twelve read heads on quarter inch centers. Unique holders for the data cards utilize concealer tabs that at all times during the play session remain with the duplicate board.

23 Claims, 11 Drawing Figures

DUPLICATE BRIDGE SCORING SYSTEM

FIELD OF INVENTION

This invention relates to scoring duplicate bridge tournaments and, more particularly, to systems utilizing computers for speed and accuracy.

BACKGROUND OF THE INVENTION

Duplicate boards for playing whist, auction bridge and now contract bridge have been known for approximately one hundred years, examples of which may be found in the patented literature. By the aid of duplicate boards, bridge hands can be preserved for subsequent play at another table. This is made possible first, by playing the cards in "duplicate style", namely, by each player retaining his own played cards, turning them face down as played in his own stack or row and, second, by each player returning his played hand to a corresponding pocket in the duplicate boards. The board is then passed to the next table. Ultimately, a comparison can be made to determine which pair performed better with given cards.

Over the years, the format for a session of duplicate bridge in medium or large tournaments has become standardized. One of the factors is that a bridge session of three hours is too short, and one of four hours is too fatiguing. The standard session is, then, three and one-half hours. To accommodate a session of about three and one-half hours, the field is broken down into "sections" (usually lettered) of thirteen to sixteen or seventeen tables each. At the start of the session, two duplicate boards are placed at each table and the cards, if not predealt, are then dealt by the players.

Since it takes about fifteen or sixteen minutes to play two boards (bridge hands), thirteen rounds of play provide about three and one-half hours of entertainment or competition. After each round, that is to say, the playing of the two boards, the East-West players move to the next table in the section in one direction, while the boards are moved to the next table in the opposite direction. If more than thirteen tables are in the section, there are still but thirteen rounds, in which, North-South pairs will not play all East-West pairs and vice versa; and not all of the boards in the section will be played.

Just how many tables there may be in a section depends upon chance if entries are taken up to the starting time of the event on an open entry basis. If attendance is miscalculated, sections may be added or deleted at the last moment. Thus, instructions may be dispatched for all those in section F to return to the entry station for reassignment to tables in sections A, B, C, D and E; or instructions may be dispatched for those assigned to tables 15 and 16 in sections A, B, C, D, E and F to return to the entry station for reassignment to new section G. This is done in order to keep the section size to a working maximum of sixteen or seventeen. The working size is so limited for several reasons. One reason is to ensure that all players play essentially (more or less) the same set of boards so that the same reasonably fair comparison can ultimately be made across the entire field. Another reason is that a single scorer is ordinarily assigned the task of scoring one section. If the section is too large, the task of tabulating scores from pickup slips to a master sheet and then match pointing and cumulating becomes burdensome to the point where results are delayed and/or accuracy is compromised. A competent scorer should, with the assistance of one helper or caddy, complete the scoring task within thirty minutes following the final round of play.

Computerized scoring has long been proposed in order to improve accuracy and speed. The most obvious systems utilize humans to read the pickup slips and to key punch the information thereon into the computer. Such a system was demonstrated, for example, by Minneapolis Honeywell for a large tournament held in the Biltmore Hotel in Los Angeles, Calif., in August, 1962. While accuracy and speed may be improved by such key punch systems, there is no cost advantage, since as much human effort is required during the bridge session to key punch information as to post manually.

In order to circumvent the key punch step, I proposed systems whereby players encoded a set of data cards corresponding to the bridge hands or boards. Thus, each duplicate board carried its own data card. In one such system, a binary punch and dial was provided at each table such as shown, for example, in my U.S. Pat. No. 3,364,339 issued Jan. 16, 1968 and entitled MATCH POINT DUPLICATE BRIDGE SCORER. In another such system, a mark sense card was provided as shown, for example, in U.S. Pat. No. 3,236,523 of Clyde R. Stein issued Feb. 22, 1966, whereby use of a bulky punch mechanism was unnecessary. In both cases, the bridge scores remain with the duplicate board until the session is over, whereupon the cards are processed. It is essential that the scores be concealed from view at least until the board is played. In order to conceal the scores, Stein shows resilient concealer strips that snap into position beneath ledges or into slots to overlie discrete spaces of the data card.

Undoubtedly, a mark sense system is superior to a punch mechanism since mark sense requires only a pencil. However, partial prepunch makes it possible to use a simple stylus, obviating a punch mechanism. Yet, for purposes of making corrections, an eraser is simpler than positive patchwork. Problems with the mark sense system of the Stein patent are that the card itself is hard to read (which is conducive to error by the players) and that the card is quite large. Since the card itself is large, the duplicate board that holds it is correspondingly large, about two or three times the size of a present day standard aluminum duplicate board. A great deal of playing room is consumed. The card requires a special reader. Thus, standard readers have twelve read heads spaced on quarter inch centers for feed through line by line reading of a card three and one-quarter inches wide. The Stein duplicate board is expensive to mold and assemble and the concealer strips are hard to manipulate, gather and retain.

The primary object of the present invention is to provide a practical mark sense system for duplicate bridge scoring utilizing a standard or near standard data card, three and one-quarter inches wide, with twelve mark areas compatable with read heads on quarter inch centers. Once a readable card format is devised, other objects are accomplished: a compact and relatively inexpensive card holder can be provided for attachment to the back of a standard duplicate board. Extra table space is not needed.

Another object of this invention is to provide improved card holders that neatly and efficiently hold a data card and which conceal scores previously applied by strips or tabs permanently attached to the holder.

Another object of this invention is to provide a new exceptionally readable type style that itself locates the areas to be marked without requiring guide blocks.

SUMMARY OF INVENTION

The main objective of the invention, namely the use of a standard data card, is achieved by a combination of features. The most significant feature is the card arrangement whereby the scores are entered according to the round number (1 to 13) rather than by the pair number. Thus, the computer program is relied upon to assign the score to the proper pair number instead of requiring the card to carry that information. Accordingly, the card space for marking the EW pair number is eliminated; it is merely necessary to mark in a control space the board number and the section number, the machine operator independently advising the computer the number of tables in play in each section. Thus, from the table number, the section size, the board number and the section designation, the scores on the data card can be unscrambled. Only thirteen data spaces are needed irrespective of section size, since the data space is not numbered for the NS pair number. The design of the type reduces the width of the data space so that the overall card length is held to under eight inches.

In one form, the card holder is a die cut polypropylene folder comprising a back part attached to the back of the duplicate board, and a front part. The data card has holes registering with short posts projecting upwardly from the back part. The front part has a series of concealer strips or tabs hinged to a lateral base or binding strip of the top part. Plastic CANOE ® clips (trademark of Illinois Tool Works, Inc.) serve as ideal releasable closures for the tabs, cooperating with holes in the back part of the folder.

In another form, the card holder takes the form of a die cast frame in the back of the duplicate board itself into which the data card is fitted. Individual concealer tabs or strips fit into the frame. Each tab contains springs cooperable with detent recesses formed in the sides of the frame. Movement of the tabs lengthwise of the data card in one direction is permitted, while movement in the other direction is limited. At the start of the session, data spaces corresponding to rounds 2 through 13 are concealed; at the end of the first round and after data is entered for round 1, the tab over round 2 is moved downwardly to snap into place over the data space for round 1, exposing the data space for round 2. Similarly, all data lines are progressively exposed round by round. To reset the board, the concealer tab or strip over line 1 is removed as by a key, and replaced over the data space for round 13.

BRIEF DESCRIPTION OF THE DRAWINGS

A detailed description of the invention will be made with reference to the accompanying drawings wherein like numerals designate corresponding parts in the several figures. These drawings, unless otherwise indicated, are to scale.

DETAILED DESCRIPTION OF THE FIRST EMBODIMENT

The following detailed description is of the best presently contemplated modes of carrying out the invention. This description is not to be taken in a limiting sence, but is made merely for purposes of illustrating the general principles of the invention, since the scope of the invention is best defined by the appended claims. Structural and operational characteristics attributed to forms of the invention first described, shall also be attributed to forms later described, unless such characteristics are obviously inapplicable or unless specific exception is made.

Figure 1:
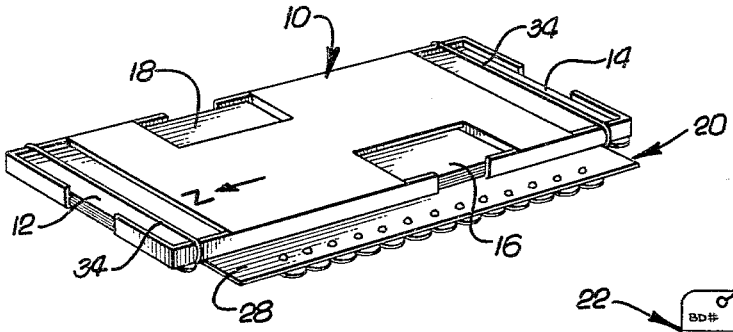
FIG. 1 is a pictorial view of a conventional duplicate board, the improved holder being attached to its back.
Figure 3:
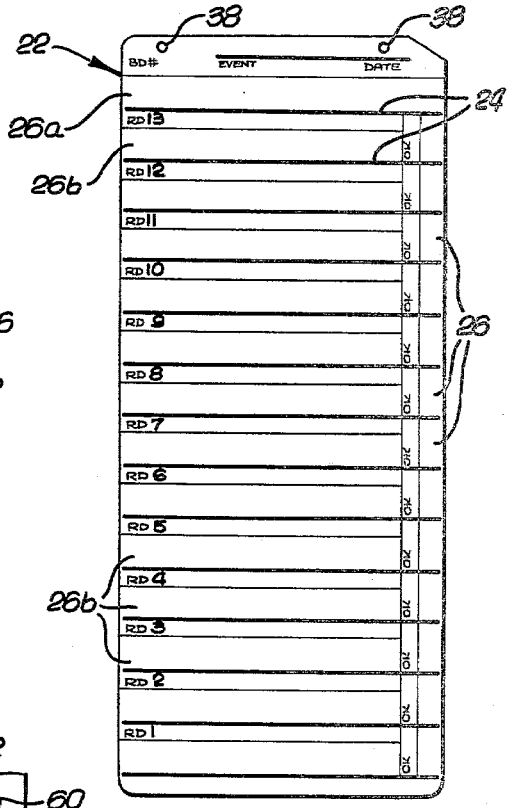
FIG. 3 is a view of the data card showing the arrangement of data lines.
Figure 2:
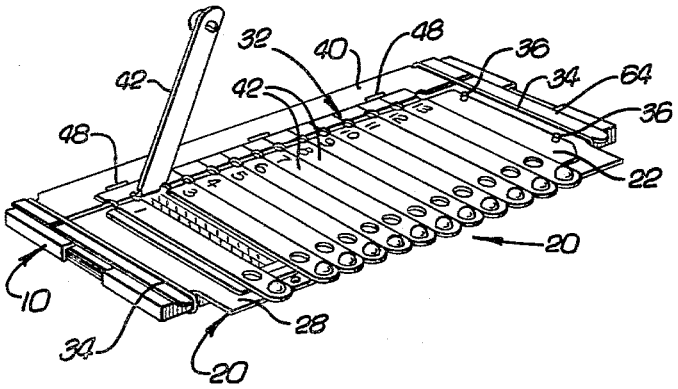
FIG. 2 is a pictorial view of the board and holder of FIG. 1, but showing the reverse or back side.
Figure 4:
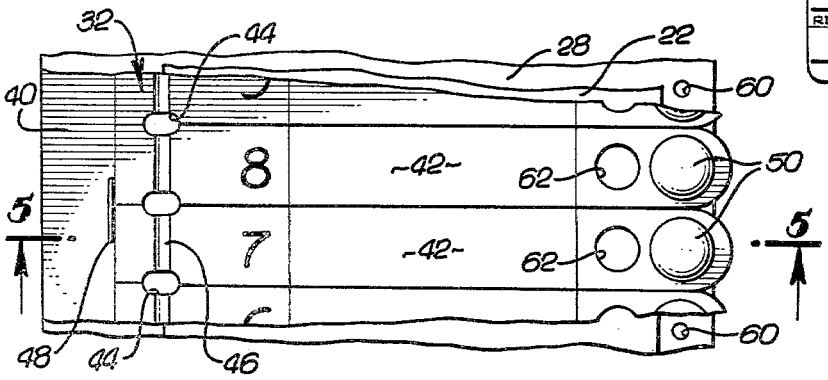
FIG. 4 is an enlarged fragmentary plan view of the holder.

In FIGS. 1 and 2, there is illustrated a conventional duplicate board 10 having four pockets 12, 14, 16 and 18 for reception of playing cards (not shown) corresponding to bridge hands. Secured to the back of the board 10 is a holder 20 for a data card 22 (FIG. 3). The data card 22 is divided by fifteen transverse clock lines 24 into fourteen individual data spaces 26. Each of the data spaces 26 is exactly six "IBM" units wide. The top space **26*a* identifies the card and the duplicate board with which it cooperates. This space 26*a* contains two lines of machine language to be pencil marked, and one line of non-machine language. One of the machine lines has twelve read spots on one-quarter inch centers for numbering the card from 1 to 39. The other machine language line identifies the section by letters A, B, C, D, E and F. The top space 26*a*** preferably is encoded before the board is distributed to the table, as by tournament personnel.

Thus, the bottom line is printed "RD 1" (round 1); the next bottom line is printed "RD 2", etc. Each space **26*b*** provides two lines for marking the bridge score in machine language and one line for handwriting the result (contract by whom played and the number result MADE or DOWN). Traditionally, the North player fills out the score and one of the opponents, West or East, approves it. The holder is attached to the duplicate board so that, when the board is turned over, the data card and holder are addressed to the North player. The handwritten line, by formula well known to the players, determines the bridge score. Hence, after the session is over, the correspondence of the handwritten line to the machine written line in the data space can be verified by a checker.

The individual data card spaces are compactly arranged to be highly readable. For this purpose, the first of the two machine language lines contains numerals on one-quarter inch spacing designating hundreds, namely, 100, 200, 300 . . . 900, as well as letters M (designating 1,000) and MM (designating 2,000). The second of the two machine language lines contains numerals on one-quarter inch spacing designating the tens, namely, 10, 20, 30, . . . 90. Thus, virtually all possible bridge scores can be marked off by one or a combination of two or three marks. (A score of over 3,000, while possible, is virtually unheard of.) The second line also contains letters to mark off which side obtained the plus score, that is, either NS (North-South) or EW (East-West). At the right hand end of each space is an "OK" square which the West player initials to indicate agreement with the score as written by North.

The machine lines for spaces **26*b*** are made readable and discrete by a combination of several features: The numerals are printed on a slant. The lead numeral is emphasized and the following ciphers are de-emphasized. No brackets are used around the letters or numerals. The type style for the lead numerals is bold and clear. The ciphers for the hundreds are reduced to oversized dots, which as such are highly readable without consuming space.

Instead of marking the numerical score in machine language, it might be simpler to mark the contract and the result, relying upon the computer to determine the bridge score. However, six individual pieces of information would have to be marked off: (1) the denomination, that is, NO TRUMP, SPADES, HEARTS, DIAMONDS, CLUBS or PASS; (2) the contract level, numbers 1 to 7; (3) the contracting side or seat, that is, NORTH, SOUTH, EAST or WEST; (4) whether DOUBLED, REDOUBLED or UNDOUBLED; (5) whether MADE or SET; (6) the number 1 to 13 MADE or SET. Except for the mark at PASS, the lack of exactly six marks signals an anomaly which must be resolved by a line for the score handwritten in arabic numbers. The chances of a player omitting one of the six essential pieces of information is substantial, whereas the chances of failing to mark the machine lines on card 22 are far less. Moreover, players are accustomed to writing by hand the contract, by whom, made or down, on conventional manual score sheets; hence, the use of machine language for the score is only a very slight change from previous standard. From a more practical standpoint, the six items for marking require a total of 33 or 35 marks. No compact arrangement of such marks has yet been devised that is easily readable both by man and machine.

All printing on the card, except the clock lines 24, is done with ink that is not picked up by the reader. For example, this printing may be in reflective red and the clock lines 24 in non-reflective black.

The holder 20 for the card 22 comprises two die cut polypropylene parts, a back part or platen 28 and a cover 32 forming a folder-like structure. Polypropylene about 0.035" has been found to provide optimum characteristics of flexibility, rigidity, etc. The back part 28 is secured to the back of the duplicate board 10, either permanently, as by rivets or adhesive, or detachably, as by snaps or, in this instance, rubber bands 34. The holder 20 and its card 22 remain with the corresponding duplicate board until the end of the session or tournament. The back part or platen 28 carries two posts 36 that register with the holes 38 in the top margin of the card, thereby to locate the card in a fixed position relative to the platen 28. The holes 38 are preferably punched as a part of the printing process so that registry between the holes 38 and the printed matter is ensured. The posts 36 may simply be short rivets the shanks of which frictionally fit holes formed in the platen.

The holder cover 32 has a base or binding strip 40 at the left hand side. Projecting from the binding strip 40 are thirteen individual concealer strips or tabs 42 corresponding in width to the width of the spaces **26*b*. The tabs 42 are part of the same piece of material as the base or binding strip 40. Holes 44 at the proximal ends of the tabs eliminate stress concentration. The tabs are hinged to the base or binding strip 40 by the aid of a hot score 46. Very slight resistance is offered to hinge movement of the concealer tabs away from coplanar relationship with the base of binding strip 40**. Hundreds of thousands of cycles of movement of the tab are possible without fatigue failure.

The cover 32 is attached to the back part 28 by the aid of heavy duty staples 48 so that the concealer tabs 42 precisely cover the spaces **26*b***. Preferably the tabs are printed to show the round number so that the proper tab is lifted by the North player.

Figure 5:
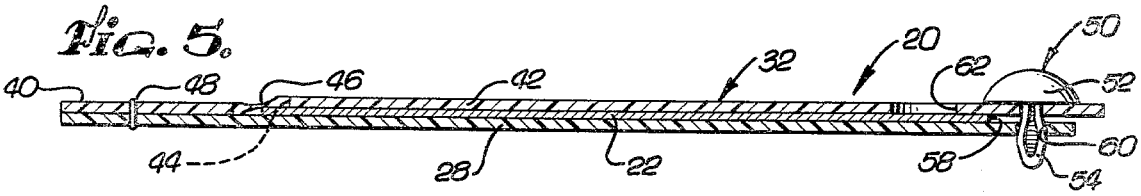
FIG. 5 is a further enlarged transverse sectional view taken along a plane corresponding to line 5—5 of FIG. 4.
Figure 6:
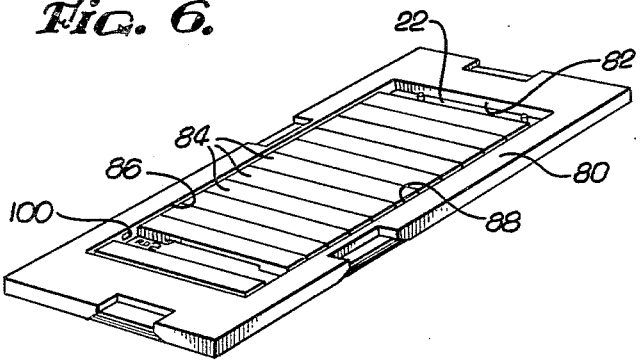
FIG. 6 is a pictorial view of a modified form of a duplicate board, and showing its reverse or back side, including an integral frame for the data card.
Figure 7:
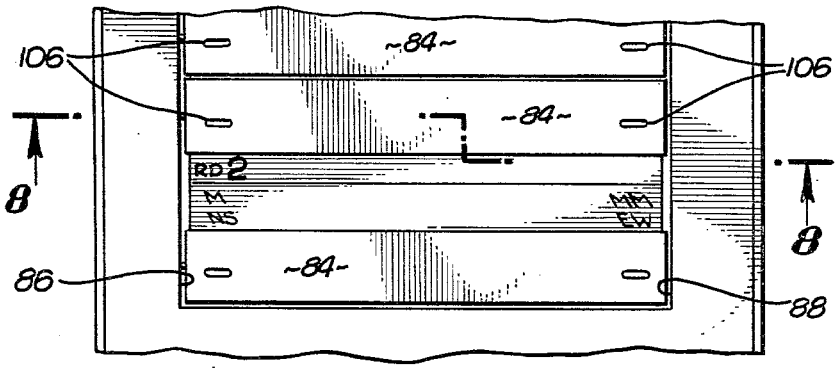
FIG. 7 is an enlarged fragmentary view showing part of the data card frame.
Figure 8:
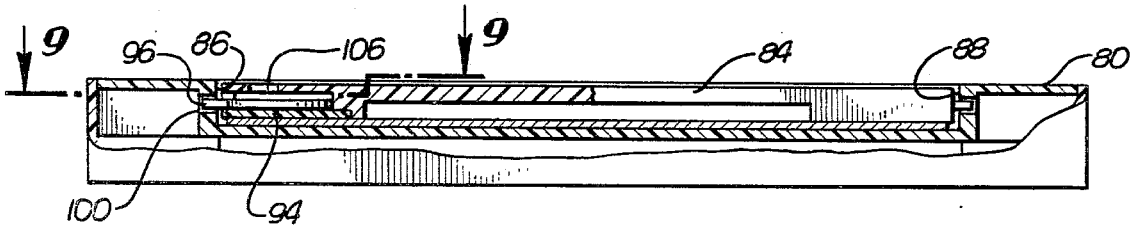
FIG. 8 is a further enlarged transverse sectional view taken along a plane corresponding to line 8—8 of FIG. 7.
Figure 9:
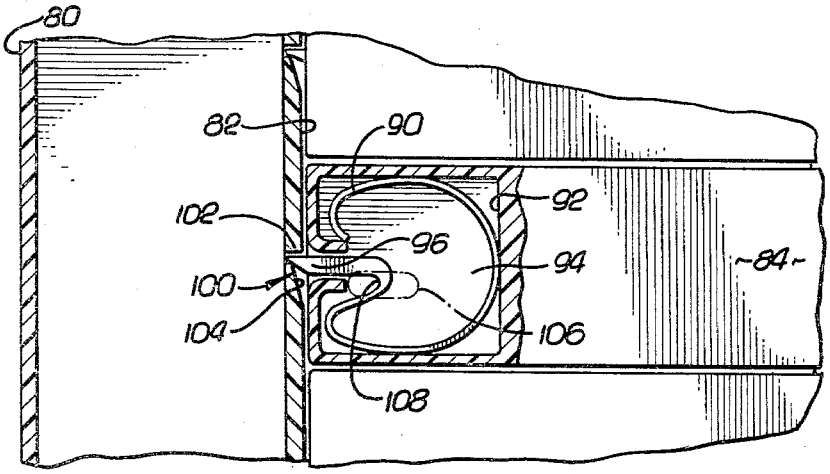
FIG. 9 is a still further enlarged fragmentary sectional view taken along a plane corresponding to line 9—9 of FIG. 8, and illustrating the spring latch mechanism.

Normally, the concealer tabs are all secured in covering relationship. For this purpose, CANOE ® clips 50 such as manufactured by the Fastex Division of Illinois Tool Works, Inc., are provided, one for each tab. The clip 50 is a one-piece molded fastener having a head 52 and a shank 54. The proximal portion of the shank diverges and the distal portion converges. The clip 50 projects through a mounting hole 56 (FIG. 5) at the distal end of the tab 42. The shank 54 of the clip clears the right hand edge 58 of the data card and enters a registering hole in the holder back 28. Cam action due to the diverging nature of the clip shank 54 secures the clip 50 to the tab and, furthermore, urges the tab toward the platen 28, thereby tightly covering the data space **26*b* so that it is effectively concealed. The top and bottom edges of the tab 42, accordingly, do not gap, which they might do if the tab were prevented from full closing by some snap or other mechanism positioned between the parts of the holder. The clip 50** interposes nothing; it merely projects through aligned holes.

As shown in FIG. 1, the distal ends of the clips 50 laterally clear the corresponding edge of the duplicate board 10 so that the back of the duplicate board 10 does not interfere with proper closure. The mounting of the holder on the board ensures this relationship. Furthermore, the overlying relationship facilitates release of the clips simply by application of digital pressure to the rounded end of the clip shank 54 until the clip pops out of the back plate hole 60. Alternately, the clip 50 can be released by digitally engaging an overhanging terminus of the tab 42.

After each round of two boards is played, the boards are passed to the next table. Preferably, an announcement, verbally and/or visually, is made that the change is for a specific numbered round. This reminds the North player what tab to lift. If everything goes as intended, thirteen spaces of information will be filled in precise order on each card. In order to assist the North player in determining what tab to lift, the score approval at previous tables is made visible. This is achieved by providing windows 62 over the "OK" square. Preferably, the West player scribbles his initial through the window 62. In the middle of the session, after say six rounds, the approval of the scores for the first six data spaces is visible at the windows 62; hence, the North player automatically lifts the tab for round 7, which has the first clean or unused window.

At the end of the session, the top edge 64 of the data card is lifted until the rivets or posts 36 are cleared, access being provided by a thumb hole 66 in the platen 28. The card can then be pulled easily from the holder for processing of data. Placement of a new data card for the subsequent session is achieved by the reverse process.

Figure 10:
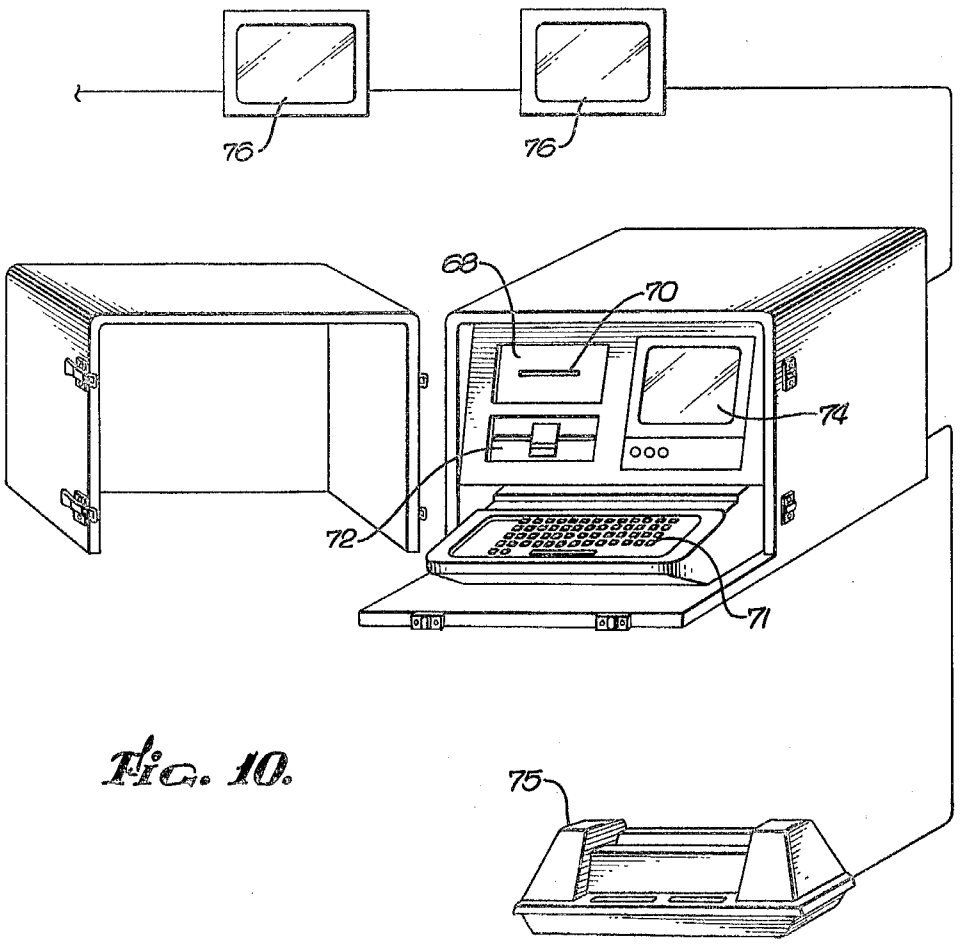
FIG. 10 is a pictorial view of computer hardware for use with the date card.

The data cards are processed by the computer hardware such as illustrated in FIG. 10. It includes a card reader 68 that, for example, returns the processed card out the same slot 70 into which it was inserted; a programmable computer proper, including a keyboard 71 for control and instructions; a disc reader 72 for transmitting the program from a disc to the computer; a monitor 74; and a printer 75. An APPLE II PLUS computer is quite suitable for use in the system. A series of secondary monitors 76 provide remote viewing by interested players during the processing. A program for processing such data cards is on file with the Library of Congress under Copyright Registration TX 434-823 in the name of Continental Counterparts, a copy of which appears below as EXHIBIT A hereto.

Figure 11:
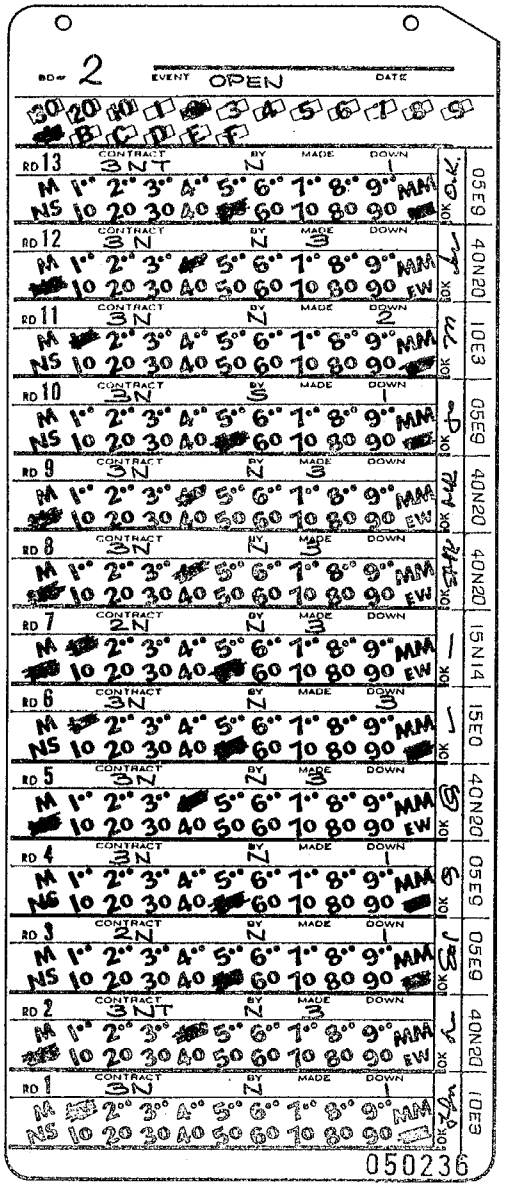
FIG. 11 is a full view of the data card.

The system preferably utilizes a reader of the type shown and described in U.S. Pat. No. 4,058,056 to Irwin Rubin entitled MICROPROCESSOR CONTROLLED CARD READER/PRINTER, issued Nov. 15, 1977, whereby characters are printed along the right hand edge of the card as illustrated in FIG. 11. The characters indicate what marks the reader picked up and the match point score assigned for that score. Thus, opposite round 10 appears 05E9, which means that the reader saw a score of 050 for EW, and that a match point score of 9 was assigned for that score.

The row of characters is printed only if the card is free of anomalies; should anomalies be present, the card is returned and the anomaly or anomalies announced on the monitor so that correction can be made. Anomalies may be failure to assign the score to EW or NS; duplication of marks (incomplete erasure); or impossible score; etc. As the card is accepted and as the card edge is printed, the monitors provide a unique display for view by the machine operator and players. The display shows the bridge score as picked up by the reader, the East-West and North-South pair numbers opposite the bridge scores, as determined by machine processing, and the match points assigned for each bridge score, also determined by machine processing. Before the match points are entered and accumulated for the total score of each pair number, a succeeding card must be fed into the reader or, in the case of the last card of the set, a command must be fed into the keyboard answering the displayed question: "IS THIS LAST BOARD CORRECT". Thus, even though the computer has accepted the card as free of anomalies, the machine operator can, particularly if there is no time pressure, check a suspicious score and reject the information as by a suitable keyboard command "R" for REJECT. Correction can be made by erasure if necessary, and the card can be put through the reader a second time on a different mode to avoid overprinting. Players watching the remote monitors can observe the process and take off their scores board-by-board. The printer 75 reproduces whatever is printed along the edge of the card so that a trace of corrections made on a card is obtained, and so that corrected cards can be identified.

After all cards of a section are processed, a printed recap sheet is produced along with printed section results. The encoded data cards are immediately displayed for all to view. Requests for score corrections can be made, should the players note any player input errors or reader failures to pick up marginal or improper marks.

DESCRIPTION OF THE SECOND EMBODIMENT

In the form of the invention shown in FIGS. 6 to 9, the back of the duplicate board provides an integral frame 80 about a recess 82 for the data card 22. The duplicate board may be made by injection molding of high impact polystyrene.

Fitted in the frame are a series of twelve identical fabricated plastic concealer tabs or strips 84 that overlie the card. Each concealer strip is essentially rectangular, corresponding in size to the size of the data card spaces **26*b*. The side edges of the strips are flat and slidably engage the side surfaces 86 and 88 of the frame recess 82. At the start of the session, the twelve strips 82 overlie data card spaces corresponding to rounds 2 through 13, thereby exposing the space for round 1. After the space for round 1 is encoded, the concealer strip over the space for round 2 is slid over the space for round 1, concealing it and at the same time, exposing the space for round 2**. The board is passed on to the next table. The North player need not uncover any space, since the correct one is already uncovered. There is but one unused space for the North player to use. The possibility of error is very largely eliminated, particularly since the tabs can move only in the forward direction, there to be locked in place until the end of the session.

In order to lock the concealer strips in place, two plastic springs 90 are provided for each of the concealer strips, one at each side. Each spring in this instance is generally G-shaped and fits a shallow, generally square bottom opening recess 92 in the strip. The recess is closed and the spring retained by a cap 94. Each spring has a tongue 96 that extends through a guide channel formed by walls of the recess and projects laterally beyond the side of the concealer strip. The tongue cooperates with ratchet or detent recesses 100 formed along the side surfaces of the frame recess 82. Each recess 100 has a shoulder 102 perpendicular to the frame edge, and a ramp part 104 that together fits the correspondingly shaped end of the tongue 96. The spring, in the position shown, is slightly coiled in its recess, which develops pressure tending to urge the tongue 96 outwardly and into engagement with the side wall of the frame and into engagement with the ratchet or detent recess 100. The spring force exerted on the ramp part 104 tends to maintain the spring fully seated, whereby the adjacent data card space is fully exposed. Application of force to the strip will cause the ramp 104 to retract the spring tongue 96 so that the strip can be moved downwardly into the open space just encoded. Reverse movement, however, is prevented by the shoulder 102. Downward movement is limited by the bottom of the frame or by engagement with the next concealer strip. Hence, exact positioning of the concealer strips is achieved without deliberate alignment by the user; the ratchet or detent recesses achieve perfect automatic alignment.

Instead of springs on the tabs and latch recesses in the frame, springs could be provided on the frame with latch recesses on the tabs. Friction and an overlying ledge arrangement could also be provided together with some release device for the end tab.

When the session is over, the bottom concealer strip is removed and reinstalled at the top of the stack of concealer strips. This is achieved by a simple key, pronged tool or by narrow instrument (not shown) inserted into one or both slots 106. The slots 106 provide access to parts of the spring, as at 108, that can thereby be engaged for release of the latch. Before the bottom strip is replaced at the top, the card can be lifted from the recess as by push holes (not shown) for moving the upper edge of the card above the frame for grasp and removal.

EXHIBIT A

LIST

© Continental Counterparts 1979

```
1 TEXT : CALL -936: GOTO 9000
10 IF NSEW=2 THEN 50
12 FOR TM=1 TO SSS:RD=(SSS-TM+TB) MOD SSS+1: IF RD(14 THEN 25
20 PRINT ". ";: NEXT TM: RETURN
25 X1=102*(RD-1)+6*(TB-1)+SC+(CN-1)*1326: IF MP(X1)=50 THEN 20
30 OF MP(X1)(10 THEN PRINT " ";: PRINT MP(X1);" ";: NEXT TM:
RETURN
50 FOR TM=1 TO SSS
55 Y=(SSS+TM-TB) MOD SSS*2+1+(SSS-13)*34:RD=10*( ASC(TMNO$(Y))-
176)+ ASC(TMNO$(Y+1))-176: IF RD#O THEN 65
60 PRINT " . ";: NEXT TM: RETURN
65 X1=102*(RD-1)+6*(TB-1)+SC+(CN-1)*1326: IF MP(X1)#50 THEN 80:
PRINT " . ";: NEXT TM: RETURN
80 IF 24-MP(X1) (10 THEN PRINT " ";: PRINT 24-MP(X1);" ";: NEXT
TM: RETURN
100 ER=O: POKE OS,O: POKE -16368,O: REM READ CARD
110 IF PEEK (IS)=207 THEN GOTO 150: IF PEEK (-16384)=205 THEN GO
TO 140: IF PEEK (IS))128 THEN GOTO 110
120 CALL -936: VTAB 5: PRINT "*** SET CDRP ONLINE - PRESS 'RETUR
N'": INPUT X$: CALL -936
125 IF X$#"R" THEN 130: IF DISFLG=O THEN 130: VTAB 22: POKE 50,1
27: PRINT ER1$: POKE 50,255
128 SC=LSC:TB=LTB:CN=LCN: GOSUB 4800:DISFLG=O: GOTO 100
130 IF X$#"M" THEN 100
140 ER= PEEK (-16368): POKE OS,128: POKE OS,O:ER=1: RETURN
150 POKE OS,64: POKE OS,O
160 IF PEEK (-16384)=205 THEN GOTO 140: IF PEEK (-16384)#210 THE
N 170
165 POKE -16368,0: IF DISFLG=O THEN 170: VTAB 22: POKE 50,127 PR
INT ER1$: POKE 50,255
168 SC=LSC:TB=LTB:CN=LCN: GOSUB 4800:DISFLG=O
170 IF PEEK (IS)=191 THEN GOTO 200: IF PEEK (IS)[128 THEN GOTO
120: GOTO 160
200 CALL READCARD
210 IF PEEK (IN(56))#255 THEN GOTO 200: IF PEEK (IN(57))#15 THEN
GOTO 220: RETURN
220 CALL -936: VTAB 5: PRINT "*** MISREAD CARD - PLEASE TRY AGAI
N": GOTO 110
250 FOR TB=1 TO SSS:TBS=(SC-1)*17+TB:X1+NTM(TBS):X2=ETM(TBS) :NPL
ACE(TB)=1:EPLACE(TB)=1
255 FOR TB=1 TO SSS:TBS=(SC-1)*17+TB:X1=NTM(TBS):X2=ETM(TBS) :NPL
ACE(TB)=1:EPLACE(TB)=1
260 FOR Y=(SC-1)*17 TO (SC-1)*17+SSS: IF X1(NTM(Y) THEN NPLACE (
TB)=NPLACE(TB)+1: IF X2(ETM(Y) THEN EPLACE(TB)=EPLACE(TB)+1: NEXT
Y,TB
270 RETURN
297 REM
298 REM * PRINT CARD *
299 REM
300 POKE OS,32: IF PEEK (IS)/16=11 THEN GOTO 340
320 CALL -936: VTAB 5: PRINT ER2$: PRINT : PRINT" THEN RE-ENTER
CARD":P$=" "
330 P$=" "
340 POKE OS,32: POKE OS+1,0: IF PEEK (IS)/16#11 THEN GOTO 300
360 CALL PRNTCARD
370 PRINT P$
390 POKE 54,240: POKE 55,253: CALL 1002: POKE OD,255-4: POKE OS+
1,0: POKE OS,0: RETURN
400 ER=O:OFFSET=O
410 IF PEEK (IS)/16=11 THEN GOTO 440
420 VTAB 5: PRINT ER2$: PRINT : PRINT" THEN RE-ENTER CARD":P$=" "
440 POKE OS,32: POKE OS+1,O: IF PEEK (IS)/16#11 THEN GOTO 410:
CALL PRNTCARD2+ OFFSET: RETURN
497 REM
498 REM * TABULATE SECTION *
499 REM
610 CALL -936: VTAB 2: PRINT "TABULATION OF SECTION ":SC$(SC,SC
): PRINT : PRINT : TAB 8: PRINT "N/S TEAM";: TAB 26: PRINT E/W TE
AM": PRINT
620 FOR X=1 TO SSS: TAB 7: PRINT X;: TAB 16: PRINT NTM(X);: TAB
25: PRINT X;: TAB 33: PRINT ETM(X): NEXT X: RETURN
700 REM
705 IF Z)9 THEN Y=Y-1: IF Z)99 THEN Y=Y-1: IF Z)999 THEN Y=Y-1:
```

-continued

EXHIBIT A

LIST

© Continental Counterparts 1979

```
IF Z)9999 THEN Y=Y-1
730 FOR X=1 TO Y: PRINT " ": : NEXT X: RETURN : REM PRINT SPACE
S
750 X=1
760 IF X$=SC$(X,X) THEN RETURN :X=X+1: IF X(7 THEN 760:X=0: RET
URN
796 REM
797 REM * CALCULATE TEAM NOS.
798 REM * X=MP POINTER , Y=NS TEAM NO. , Z=EW TEAM NO.
799 REM
800 SSS=ABS (SS(SC)):OFFSET=O: IF SSS MOD 2=O AND RD) 7 THEN OF
FSET=1:X=102*(RD-1)+6*(TN-1)+SC+(CN-1)*1326:Y=((SSS-RD+TB) MOD SS
S)+1
825 Z=(2*(SSS+1-RD)-OFFSET+TB-1) MOD SSS+1: RETURN
1000 X=40: POKE OS,128: POKE OS,O:LF$="


": REM LF$=CTRL-L
1002 VTAB 15: PRINT "PLEASE ALLOW ";X;" SECONDS FOR INITIALIZING"
1005 ER=O:CN=1:OFFSET=O:NTTAL=O:ETTAL=O:OP=7:X1=O:X2=O
1007 DIM IN(60),SC$(6):SC$="ABCDEF"
1010 FOR X=1 TO 60:IN(X-1)=-32385+X: NEXT X
1020 TB=17:SC=6:RD=13:X=(102*(RD-1)+6*(TB-1)+SC)*2: DIM MP(X) :Z=
50
1040 FOR Y=1 TO X:MP(Y)=Z: NEXT Y
1045 PRINT " "
1050 DIM BRIDGECLUB$(40), AREA$(40),TOURN$(40),SS(6),NTM(102),ET
M(102),NPLACE(TB),EPLACE(TB)
1070 FOR X=1 TO 6
1075 FOR Y=1 TO 17
1080 Z=(X-1)*17+Y:NTM(Z)=O:ETM(Z)=NTM(Z): NEXT Y,X
1095 DIM Y$(10),X$(40),DTE$(20),P$(82),TMNO$(180),TMHD$(80)
1096 TMNO$="0107130612051104100309020800000000010007130612051104
100309020800000001080007000613051204110300209000001080 00"
1097 TMNO$ ( LEN(TMNO$)+1)="007000613051204110310020900010900080
0070006000513041203110210"
1098 TMHD$="1 2 3 4 5 6 7 8 9 10 11 12 13
14 15 16 17"
1100 TEXT : CALL -936:VTAB 3: PRINT " "
1101 INPUT "TODAYS DATE ",DTE$
1105 INPUT "TOURNAMENT ",BRIDGECLUB$
1110 INPUT "LOCATION/AREA ",AREA$
1115 INPUT "EVENT ",TOURN$
1120 POKE 34,12:VTAB 12
1125 X$="SIZE OF SECTION "
1130 PRINT X$;: INPUT "A ",SS(1): VTAB 12: CALL -958: PRINT X$;
"A ";SS(1): PRINT : POKE 34,14
1135 PRINT X$;: INPUT "B ",SS(2): VTAB 14: CALL -958: PRINT X$;
"B ";SS(2): PRINT : POKE 34,16
1140 PRINT X$;: INPUT "C ",SS(3): VTAB 16: CALL -958: PRINT X$;
"C ";SS(3): PRINT : POKE 34,18
1145 PRINT X$;: INPUT "D ",SS(4): VTAB 18: CALL -958: PRINT X$;
"D ";SS(4): PRINT : POKE 34,20
1150 PRINT X$;: INPUT "E ",SS(5): VTAB 20: CALL -958: PRINT X$;
"E ";SS(5): PRINT : POKE 34,22
1155 PRINT X$;: INPUT "F ",SS(6): VTAB 22: CALL -958: PRINT X$;
"F ";SS(6): PRINT : POKE 34,24
1160 ER=O: FOR X=1 TO 6: IF SS(X)#O AND (SS(X)[13 OR SS(X)]17)
THEN ER=1: NEXT X: IF ER=1 THEN 1190
1180 INPUT "IS ABOVE INFORMATION CORRECT? ",X$
1184 IF X$=" " THEN 1180: IF X$(1,1)="Y" THEN 1192: IF X$(1,1)#"N
"THEN 1180
1190 PRINT " ": VTAB 12: CALL -958: GOTO 1120
1192 FOR X=1 TO 6: IFF SS(X)=O THEN SS(X)=-1: NEXT X: TEXT
1194 DIM ER1$(45),ER2$(45)
1195 LSC=1:LTB=1:LCN=1:ER1$=" THIS CARD IS REJECTED "
1196 ER2$="*** PLEASE CHECK CDRP - PRESS 'RETURN'"
1200 GOSUB 100:DISFLG=O: IF ER=O THEN 1201: IF OP=3 THEN RETURN :
GOTO 5000
1201 CN=1: IF PEEK (-32382) MOD 8]3 THEN CN=2
1202 CALL IDENTIFYCARD
1203 TB= PEEK (-32384) :SC= PEEK (-32382) :SS= PEEK (-32382)
1204 TEXT : CALL -936: VTAB 3: PRINT "TABLE NO. ";TB;" SECTION "
;SC;" SIZE ";SS
1205 CALL SCRE: VTAB 5
1208 IF PEEK (-32383)]6 THEN 1225: IF SS( PEEK (-32383))= PEEK
(-32382) THEN 1220: POKE -32258,255
1215 PRINT "*** SIZE - SECTION MISMATCH"
1220 IF PEEK (-32258)=O THEN 1300
1225 P$=" ": GOSUB 300
```

-continued

EXHIBIT A

LIST © Continental Counterparts 1979

```
1230 IF PEEK (-32384)#255 THEN 1240
1235 PRINT "*** TABLE NO. ERROR"
1240 IF PEEK (-32383)#255 THEN 1250
1245 PRINT "*** SECTION ERROR"
1250 IF PEEK (-32382)#255 THEN 1270
1255 PRINT "*** SECTION SIZE ERROR"
1270 FOR X=1 TO 52: IF PEEK (-32381+X)#255 THEN 1295: GOTO (1270
+5*(1+(X-1) MOD4))
1275 PRINT "*** BAD SCORE AT";: TAB 30: PRINT 13-(X-1)/4: GOTO
1295
1280 PRINT "*** BAD DATA AT";: TAB 30: PRINT 13-(X-1)/4: GOTO
1295
1285 GOTO 1275
1290 PRINT "*** BAD EW / NS AT";: TAB 30: PRINT 13-(X-1)/4
1295 NEXT X: GOTO 1200
1300 REM
1301 REM * CARD DETERMINED WHOLE *
1302 REM
1320 CALL MTCHPNT: REM DETERMINE MATCHPOINTS
1321 CALL -31152: IF PEEK (-32257)#156 THEN 1340: IF PEEK (-3225
8)=O THEN 1400
1340 VTAB 5
1350 PRINT "*** MATCHPOINT ERROR - TRY AGAIN"
1355 PRINT : PRINT "HIT 'RETURN'"
1360 P$=" ": GOSUB 300
1370 INPUT X$: GOTO 1200
1400 REM
1401 REM * CALL ROUTINE TO PRINT CARD *
1402 REM
1420 TB= PEEK (-32384):SC= PEEK (-32383):RD=1:X=102*(RD-1)+6*(TB
-1)+SC+(CN-1)*1326: IF MP(X)#50 THEN 1900: REM DUPLICATE CARD
1505 POKE -31222,CN+64: REM PRINT CN ON CARD
1506 IF OP#3 THEN 1510
1507 P$=" ": GOSUB 300
1508 GOTO 1515
1510 GOSUB 400
1515 POKE -31222,32
1520 Z=(TB-1)*2+CN
1522 CALL -936: VTAB 3: PRINT "SECTION ";SC$(SC,SC);: TAB 25:
PRINT Z;" PLAY/MAKE ";
1524 IF SS(SC)#13 THEN 1526: PRINT : GOTO 1535
1526 IF SS(SC)#14 THEN 1528: PRINT (Z+1) MOD (SS(SC)*2)+1: GOTO
1535
1528 PRINT (Z+3) MOD (SS(SC)*2)+1
1535 VTAB %: PRINT "RND";: TAB 8: PRINT "NS";: TAB 13: PRINT "M.
P.";: TAB 20: PRINT "SCORE";
1537 TAB 29: PRINT "M.P.";: TAB 35: PRINT "EW": VTAB 7
1540 FOR RD=1 TO 13: GOSUB 800:Z1=Z
1545 S=((SSS-RD+TB) MOD SSS)+1:T=(2*(SSS+1-RD)-OFFSET+TB-1) MOD
SSS+1:W=(13-RD)#4:Z=-32377+W
1550 MP(X)=PEEK (-32379+W): PRINT " ";RD;: TAB 8: PRINT Y;: TAB
13: PRINT MP(X):
1555 IF PEEK (Z-3)+ PEEK (Z-1)#0 THEN 1556: TAB 19: PRINT "----";
: GOTO 1557
1556 TAB 18+( PEEK (Z)-1)*2: PRINT PEEK (Z-3)*100+ PEEK (Z-1)*10;
1557 TAB 30: PRINT 24-MP(X);: TAB 35: PRINT Z1
1560 U=(SC-1)*17+S:V=(SC-1)*17+T:NTM(U)=NTM(U)+MP(X):ETM(V)=ETM(
V)+24-MP(X): NEXT RD
1590 IF OP=3 THEN RETURN
1595 VTAB 1: POKE 34,1: POKE 50,63: PRINT " PRESS 'R' TO
REJECT CARD ": POKE 50,255
1597 LSC=SC:LTB=TB:LCN=CN:DISFLG=1: REM LAST CARD I.D.
1599 REM
1600 REM CHECK FOR ANY MISSING CARDS
1601 REM
1610 ER=O:RD=1: FOR TB=1 TO SS(SC): FOR CN=1 TO 2
1650 X=102*(RD-1)+6*(TB-1)+SC+(CN-1)*1326: IF MP(X)#50 THEN 1680:
ER1=CN:CN=2:ER=TB:TB=SS(SC)
1680 NEXT CN,TB
1700 IF ER=O THEN 1735
1710 VTAB 22:PRINT "MISSING STARTING TABLE NO. ";ER;" CARD ";
SC$(ER1,ER1)
1730 GOTO 1200: REM CARDS STILL MISSING
1735 VTAB 22: PRINT "IS THIS LAST CARD GOOD? (Y/N) "
1740 IF PEEK (-16384)=89+128 THEN 1790
1745 IF PEEK (-16384)#206 THEN 1740
1750 SC=LSC:TB=LTB:CN=LCN
1755 VTAB 22: POKE 50,127: PRINT " THIS CARD IS REJECTED
": POKE 50,255
1760 GOSUB 4800: GOTO 1200
```

-continued

EXHIBIT A

LIST © Continental Counterparts 1979

```
1790 POKE (−16368),0
1810 GOSUB 2000
1820 SS(SC)=− ABS (SS(SC))
1830 X=1: REM SEARCH FOR INCOMPLETE SECTION
1840 IF SS(X)]=0 THEN GOTO 1200
1850 X=X+1
1860 IF X#7 THEN 1840
1861 X2=0: REM FLAG TO PRINT ALL SECTIONS
1862 GOSUB 2800: REM ALL CARDS ARE IN
1865 REM
1870 REM
1871 REM * END OF PROGRAM *
1872 REM
1875 REM
1880 GOTO 5000
1890 REM
1900 REM
1901 REM * DUPLICATE CARD FOUND *
1902 REM
1910 X=−31227
1912 IF OP#3 THEN 1920
1914 P$=" ": GOSUB 300
1916 GOTO 1932
1920 POKE X,88: POLE X+5,88
1930 GOSUB 400
1932 CALL −936: VTAB 5: PRINT "DUPLICATION ERROR !":VTAB 10:PRIN
T "CORRECT ERROR IN MANUAL MODE"
1935 X=31227
1940 POLE X,32: POLE X+5,32
1970 VTAB 20: PRINT "TABLE NO. ";TB;" SECTION ";
1980 PRINT SC$(SC,SC)
1985 IF OP=3 OR OP=4 THEN RETURN
1990 GOTO 1200
2000 REM
2001 REM * PRINT SECTION SCORES *
2003 REM
2010 SSS= ABS (SSC(SC)): CALL 768: PRINT BRIDGECLUB$;:Y=40− LEN(
BRIDGECLUB$)− LEN (AREA$)/2
2045 FOR X=1 TO Y: PRINT " ";: NEXT X: PRINT AREA$;:Y=39− LEN(TO
URN$)− LEN(AREA$)/2
2055 FOR X=1 TO Y: PRINT " ";: NEXT X: PRINT TOURN$: PRINT : PRI
NT "SECTION ";SC$(SC,SC);
2080 FOR X=1 TO 70− LEN(DTE$): PRINT " ";: NEXT X: PRINT DTE$: P
RINT : PRINT
2100 GOSUB 255
2160 PRINT :NTTAL=O:ETTAL=O
2300 FOR TB=1 TO SSS:TBS=(SC−1)*17+TB: PRINT NTM(TBS)/2;".";(NTM
(TBS MOD 2)*5;:NTTAL=NTTAL+NTM(TBS)
2320 Z=NTM(TBS)/2:Y=68: GOSUB 705: PRINT ETM(TBS)/2;".";(ETM(TBS
) MOD 2)*5:ETTAL=ETTAL+ETM(TBS): PRINT NPLACE(TB);:Z=O
2360 FOR X=1 TO SSS: IF NPLACE(X)=NPLACE(TB) THEN Z=Z+1: NEXT X
2390 IF Z#1 THEN 2400:Z=9: GOTO 2410
2400 PRINT "-";NPLACE(TB)+Z−1;:Z=1000: IF NPLACE]9 THEN Z=10000:
IF NPLACE +Z−1[10 THEN Z=100
2410 Y=/2: GOSUB 705: PRINT EPLACE(TB);:Z=O
2440 FOR X=1 TO SSS: IF EPLACE(X)=EPLACE(TB) THEN Z=Z+1: NEXT X
2470 IF Z=1 THEN 2500: PRINT "-";EPLACE(TB)+Z−1;
2500 PRINT : PRINT : NEXT TB
2550 PRINT : PRINT
2560 PRINT NTTAL/2;".";(NTTAL MOD 2)*5;:Z=NTTAL/2:Y=70: GOSUB
705: PRINT ETTAL/2;".";(ETTAL MOD 2)*5
2580 PRINT LF$: POKE 54,240: POKE 55,253: CALL 1002: RETURN
2800 CALL 768: IF X2=) THEN 2805:SC=X2: GOTO 2810
2805 FOR SC=1 TO 6
2810 IF SS(SC)=−1 THEN 2985:SSS= ABS (SS(SC)): FOR NSEW=1 TO 2
2825 PRINT BRIDGECLUB$;', ";AREA$;:Y=78− LEN(AREA$)− LEN(TOURN$)−
LEN(BRIDGECLUB$): GOSUB 730: PRINT TOURN$
2835 PRINT : PRINT "SECTION ";SC$(SC,SC);:Y=71− LEN(DTE$): GO
SUB 730: PRINT DTE$: PRINT
2850 FOR X=1 TO 20: PRINT "----";: NEXT X: PRINT : PRINT " BOARD
";:Y=26+(SSS−13)*2: GOSUB 730
2860 IF NSEW=2 THEN 2870: PRINT "NSPAIR #": GOTO 2875
2870 PRINT "EW PAIR #"
2875 PRINT "PLAY MAKE ";: PRINT TMHD$(1,SSS*4−3): FOR X=1 TO
20: PRINT "----";: NEXT X: PRINT : FOR Z=1 TO SSS*2:Y=2: GOSUB
705
2890 X=(Z+1) MOD 2+1
2900 PRINT Z;" ";SC$(X,X);" ";: IF SSS#13 THEN 2915: PRINT " "
;: GOTO 2945
2915 IF SSS#14 THEN 2935: PRINT (Z+1) MOD (SSS*2)+1;: IF (Z+1) M
```

-continued

EXHIBIT A

LIST © Continental Counterparts 1979

```
OD (SSS*2)+1(10 THEN PRINT " ";: GOTO 2945
2935 PRINT (Z+3) MOD (SSS*2)+1;: IF (Z+3) MOD (SSS*2)+1(10 THEN
PRINT " ";
2945 PRINT " ";:TB=(Z+1)/2:CN(Z+1) MOD 2+1: GOSUB 10: PRINT
: IF Z MOD 2=O THEN PRINT : NEXT Z: PRINT LF$: NEXT NSEW
2985 IF X2#0 THEN 2990: NEXT SC
2990 PRINT LF$: POKE 54,240; POKE 55,253: CALL 1002: RETURN
4800 IF SS(SC)=-1 THEN RETURN : SS(SC)= ABS (SS(SC):
4830 FOR RD=1 TO 13:OFFSET=O: IF SS(SC) MOD 2=O AND RD)7 THEN OF
FSET=1:X=102*(RD-1)+6*(TB-1)+SC+(CN-1)*1326
4845 S=((SS(SC)-RD+TB) MOD SS(SC))+1:T=(2*(SS(SC)+1-RD)-OFFSET+
TB-1) MOD SSC(SC)+1:W=(13-RD)*4:Z=-323/7+W
4860 U=(SC-1)*17+S:V=(SC-1)*17+T:NTM(U)=NTM(U)-MP(X):ETM(V)=ETM
(V)-24+MP(X)=50
4870 NEXT RD: RETURN
5000 TEXT : CALL -936: VTAB 2: PRINT " M E N U F O R M A N U A
L  M O D E"
5020 PRINT : FOR X=1 TO 40: PRINT "*";: NEXT X: PRINT :PRINT
5040 TAB 5: PRINT "1)";: TAB 15: PRINT "DISPLAY COMPANION CARDS"
5050 PRINT : TAB 5: PRINT "2)";: TAB 15: PRINT "DELETE SINGLE CA
RD"
5060 PRINT : TAB 5: PRINT "3)";: TAB 15: PRINT "RE-ENTER CARD"
5070 PRINT : TAB 5: PRINT "4)";: TAB 15: PRINT "PRINTOUT ALL MAT
CHPOINTS"
5080 PRINT : TAB 5: PRINT "5)";: TAB 15: PRINT "PRINTOUT SECTION
TOTALS"
5082 PRINT : TAB 5: PRINT "6)";: TAB 15: PRINT "DELETE SECTION(S
)"
5085 PRINT : TAB (5): PRINT "7)";: TAB 15: PRINT "RETURN TO AUTO
MODE"
5090 POKE 34,22: VTAB 22: INPUT "PLEASE SELECT OPTION ",OP
5100 IF OP[1 OR OP]7 THEN 5000: IF OP#1 AND OP#2 AND OP#5 THEN
5130
5115 VTAB 22: INPUT "SECTION ",X$
5120 GOSUB 750: IF X=O THEN 5115:SC=X
5125 IF SS(SC)#-1 THEN 5130: PRINT "SIZE OF SECTION ";SS;" IS O"
;: FOR X=1 TO 500: IF X MOD 50=O THEN PRINT " ";: NEXT X: GOTO 5000
5130 IF OP#1 AND OP#2 THEN 5150
5135 VTAB 22: INPUT "STARTING TABLE NO. ",TB
5140 IF TB[=O OR TB]SS(SC) THEN 5135
5150 IF OP#2 THEN 5180
5155 VTAB 22: INPUT "CARD NO. ",X$
5160 GOSUB 750: IF X[1 OR X]2 THEN 5155
5165 CN=X
5180 IF OP#4 AND OP#6 THEN 5240
5200 TEXT : CALL -936: VTAB 3
5204 PRINT "PLEASE SELECT SECTION"
5206 VTAB 6: PRINT " O)";: TAB 12: PRINT "ALL SECTIONS": PRINT
5210 PRINT " 1)";: TAB 12: PRINT "A": PRINT
5212 PRINT " 2)";: TAB 12: PRINT "B": PRINT
5214 PRINT " 3)";: TAB 12: PRINT "C": PRINT
5216 PRINT " 4)";: TAB 12: PRINT "D": PRINT
5218 PRINT " 5)";: TAB 12: PRINT "E": PRINT
5220 PRINT " 6)";: TAB 12: PRINT "F": PRINT
5222 POKE 34,23: VTAB 24: INPUT " ",X2
5230 IF X2[0 OR X2]6 THEN 5200
5240 TEXT
5250 IF OP=1 THEN 5500
5255 IF OP=2 THEN 5300
5260 IF OP=3 THEN 5800
5265 IF OP=4 THEN 5400
5270 IF OP=5 THEN 5600
5275 IF OP=6 THEN 5700
5280 IF OP=7 THEN 1200
5300 TEXT : CALL -936: REM OPTION 2
5305 VTAB 2: PRINT "SECTION ";SX$(SC,SC);" TABLE NO. ";TB;"
CARD ";SC$(CN,CN);" DELETED"
5310 GOSUB 4800
5380 VTAB 5: GOTO 5505
5400 GOSUB 2800: REM OPTION 4
5410 GOTO 5000
5500 TEXT: CALL -936: VTAB 2: REM OPTION 1
5505 PRINT "STARTING TABLE #";TB;: TAB 30: PRINT "SECTION ";
SC$(SC,SC)
5507 PRINT : PRINT : PRINT "ROUND";: TAB 10: PRINT "TEAM #";:
TAB 29: PRINT "CARDS"
5510 TAB 7: PRINT " N/S E/W";: TAB 26: PRINT "A B":
PRINT
5520 FOR RD=13 TO 1 STEP -1:CN=1: GOSUB 800
5525 PRINT " ";RD;: TAB 10: PRINT Y;: TAB 15: PRINT Z;: TAB 25
```

-continued

EXHIBIT A

LIST © Continental Counterparts 1979

```
5530 IF MP(X)=50 THEN 5532: PRINT MP(X);
5532 CN=2:X=102*(RD-1)+6*(TB-1)+SC+(CN-1)*1326
5535 TAB 35: IF MP(X)=50 THEN 5540: PRINT MP(X): GOTO 5550
5540 PRINT
5550 NEXT RD
5560 INPUT X$: GOTO 5000
5600 CALL -936: VTAB 3: PRINT "THIS WILL TAKE 20 SECONDS": GOS
UB 2000
5620 GOTO 5000
5700 REM OPTION 6 - DELETE SECTION(S)
5705 IF X2=0 THEN 5710:SC=X2: GOTO 5715
5710 FOR SC=1 to 6
5715 IF SS(SC)=-1 THEN 5760:SS(SC)= ABS (SS(SC))
5720 FOR TB=1 TO SS(SC)
5723 FOR RD=1 TO 13
5735 X=102*(RD-1)+6*(TB-1)+SC:MP(X)=50:MP(X+1326)=50: NEXT RD,
TB
5760 IF X2#0 THEN 5000
5765 NEXT SC: GOTO 5000
5800 TEXT : GOSUB 1200: FI ER#0 THEN 5000: PRINT : INPUT "PRESS
'RETURN' TO CONTINUE" X$: GOTO 5000
9000 SSS=0:TBS=0
9005 DISFLG=0
9010 VTAB 5: PRINT "VERSION 4,0";: TAB (18) : PRINT "RELEASED
-DEC 9, 1979"
9015 READCARD=-32512: REM $8100
9020 SCR=-32256: REM $8200
9025 PRNTCARD=-32464: REM $8130
9030 MTCHPNT=-31488: REM $8500
9035 IDENTIFYCARD=-31744: REM $8400
9040 PRNTCARD2=-31228: REM $8604
9045 ID=-16240:IS=-16239:OD=-16238:OS=-16237
9050 GOTO 1000
20000 INPUT "SECTION",SC: REM NOT PART OF PROGRAM
20010 IF SC#0 THEN 20020
20012 CALL 768: PRINT LF$
20018 POKE 54,240: POKE 55,253: CALL 1002: REM RE-CONNECT VIDEO
20019 GOTO 5000
20020 INPUT "TABLE",TB
20030 IF TB=0 THEN 20000
20040 INPUT "CARD",CN
20050 IF CN-0 THEN 20020
20060 INPUT "ROUND",RD
20070 IF RD=0 THEN 20040
20080 X=102*(RD-1)+6*(TB-1)+SC+(CN-1)*1326
20090 INPUT "MATCHPOINT",MP
20095 MP(X)=MP
20100 PRINT "MP(";X;")=";MP(X)
20110 CALL 768
20120 PRINT "SECTION ";SC;" ";
20130 PRINT "TABLE ";TB;" ";
20140 PRINT "CARD ";CN;" ";
20150 PRINT "ROUND ";RD;" ";
20160 PRINT "ADDR. ";X;" ";
20170 PRINT "MP "1MP(X)
20180 POKE 54,240: POKE 55,253: CALL 1002: REM RE-CONNECT VIDEO
20190 GOTO 20060
21000 FOR TB=1 TO 17
21010 SC=2
21020 TBS=(SC-1)*17+TB
21025 PRINT TBS;: TAB 10
21030 PRINT NTM(TBS);: TAB 20: PRINT ETM(TBS)
21040 NEXT TB
30000 REM ID=$C090(-16240);IS=$C091(-16239);OD=$C092(-16238);
OS=$C093(-16237)
```

© Continental Counterparts 1979

Intending to claim all novel, useful and unobvious features shown or described, I make the following claims:

1. In match point duplicate scoring apparatus cooperable with a deck of playing cards and with a data card divided by substantially equally spaced transverse parallel lines into a series of individual spaces for writing information corresponding to results of card play:

(a) a duplicate bridge board having four pockets for four sets of thirteen cards corresponding to individual bridge hands;

(b) said duplicate board also having a holder for said data cards;

(c) a series of elongated concealer strips each of the same width corresponding to that of said data card spaces;

(d) each of said concealer strips extending parallel to each other to extend transversely of said data card;

(e) each of said concealer strips being individually manually movable to conceal and to reveal said data card spaces; and (f) means for retaining said concealer strips with said holder during movement of said concealer strips from concealing position to revealing position and from revealing position to concealing position during the course of use in a play session, whereby said concealer strips are prevented from detaching from the holder.

2. In match point duplicate scoring apparatus cooperable with a data card divided by substantially equally spaced transverse parallel lines into a series of individual spaces for writing information corresponding to results of card play:

(a) means forming a platen for said data card;

(b) means for attaching said platen to a duplicate board so that the data card and the duplicate board remain together during a play session;

(c) register means releasably holding said data card for releasably holding the data in a fixed position on said platen;

(d) a series of elongated concealer strips each of the same width corresponding to that of said data card spaces;

(e) each of said concealer strips extending parallel to each other transversely of said data card;

(f) each of said concealer strips being individually manually movable to conceal and to reveal said data card spaces; and (g) means for retaining said concealer strips with said holder during movement of said concealer strips from concealing position to revealing position and from revealing position to concealing position during the course of use in a play session whereby said concealer strips are prevented from detaching from said platen and said duplicate board.

3. The combination as set forth in claim 2 in which said platen is surrounded by a frame that fits the data card, thereby forming said register means, each of said concealer strips being slidably mounted between the sides of said frame for movement longitudinally of said data card and transverse to the concealer strip and said data card spaces.

4. The combination as set forth in claim 3 together with yielding spring and latch means for releasably holding said concealer strips in registry with said data card lines.

5. The combination as set forth in claim 3 together with yielding spring and latch means for releasably holding said concealer strips in registry with said data card lines; said spring and latch means including means for limiting or preventing movement of said concealer strips in one direction whereby concealer strips, once positioned over a marked data card space, cannot be moved to revealing position during the play session; and means accessible to an authorized person for overriding said movement limiting or preventing means.

6. The combination as set forth in claim 3 in which said concealer strips carry spring means at opposite sides having projecting latch parts, the sides of said frame having a series of latch recesses for receiving said latch parts; said latch parts and latch recesses having a configuration to prevent reverse movement of said concealer strips; said latch parts and latch recesses normally retaining said concealer strips in said frame; and key means for forcibly retracting said latch parts for resetting the apparatus for the next play session.

7. The combination as set forth in claim 2 in which said concealer strips are individually hinged at the side of the platen, the distal end of each concealer strip extending beyond the edge of the data card; and releasable latch means for securing the distal end of each concealer strip at said platen.

8. The combination as set forth in claim 7 in which said concealer strips are die cut from material having the characteristics of polypropylene sheet material, there being scores whereby the strips are hinged.

9. The combination as set forth in claim 7 in which said platen and said concealer strips are made of polypropylene sheet material, said concealer strips all extending from a base or binding strip of the same material attached to the side of the platen; said register means comprising a pair of posts projecting upwardly through holes in the platen to engage register holes in said data card; and concealer strips being hinged to the said base or binding strip by score lines, the distal ends of the concealer strips extending beyond the card edge; and clips mounted on the distal ends of the concealer strips releasably engaging holes in the platen to hold the concealer strips in concealing position.

10. The combination as set forth in claim 9 in which said clips have heads and shanks extending through holes in the distal ends of the concealer strips, said shanks tapering to produce a cam action for holding the concealer strips to the platen without structure between the concealer strips and the platen whereby gapping at the edges of the concealer strips is avoided.

11. In a system for match point scoring duplicate bridge tournaments:

(a) a machine readable data card having at least thirteen data spaces for player encoding of duplicate bridge results;

(b) said machine readable data card also having at least one separate data space for identification of the card as a particular duplicate board in a section;

(c) each of said first thirteen data spaces having nine read spot areas demarked by numerals to symbolize 100, 200, 300, 400, 500, 600, 700, 800 and 900, and having nine read spot areas demarked by numerals to symbolize 10, 20, 30, 40, 50, 60, 70, 80 and 90, and having two read spot areas demarked by letters to symbolize North-South and East-West, respectively;

(d) each of said first thirteen data spaces also having a space for writing by hand the contract and result, thus to provide an anomaly check with the read spot areas;

(e) legend means identifying said first thirteen data spaces by play round numbers 1 through 13, respectively;

(f) a reader for sensing marks at said read spot areas; and (g) a computer programmed to identify the North-South and East-West players for each play round according to the identification of the data card and according to information supplied as to the number of players or tables in the section.

12. The system as set forth in claim 11 in which the ciphers are reduced in size relative to the other numberals to increase readability.

13. The system as set forth in claim 12 in which said numerals are centered on the read spots, the spaces between adjacent numerals being free of demarcations.

14. In a system for match point scoring a duplicate bridge tournament for a section containing at least thirteen to about sixteen or seventeen tables, and utilizing a set of duplicate boards distributed two to the table and passed thirteen times during a bridge session to successive tables:

(a) a corresponding set of machine readable data cards for said duplicate boards, respectively, each of said data cards having thirteen data spaces for player encoding of duplicate bridge results; each of said cards having a separate data space for identifying the associated duplicate board; each of said thirteen spaces being consecutively numbered by round;

(b) a reader for said data cards; and (c) a computer programmed to unscramble the bridge scores according to pair numbers, to match point each duplicate board according to the ranking of bridge scores, to assign the match points on each duplicate board to the proper pair numbers, to cumulate the match point totals for each pair number, and to command a printer or other output mechanism to provide the ultimate results.

15. The system as set forth in claim 14 in which said computer includes a monitor for displaying, as the cards are read, the scores and match point results achieved by each pair playing the corresponding board.

16. The system as set forth in claim 15 in which the match point scores for each card are held without being cumulated until the next card is fed.

17. The system as set forth in claim 15 in which said reader includes prints on the edge of the card, the information picked up by the reader as well as the match point score of the corresponding pairs whereby the scores can be verified or corrected by interested players as the cards are fed back immediately following processing.

18. The system as set forth in claim 15 in which said printer produces a written record corresponding to the match point and score information produced on the monitor.

19. In a match point duplicate scoring system cooperable with a set of duplicate bridge boards:

(a) a set of data cards, one of each duplicate board; each of said data cards having a series of individual data spaces for writing in machine readable language, bridge results or scores obtained by each pair playing the corresponding board;

(b) data processor means;

(c) a reader for said data cards; said reader including means for printing human readable language on the card immediately following read operations; and (d) a processor for directing the printing means to print on the card the match point scores calculated from said bridge scores or results.

20. For use with a match point duplicate scoring system cooperable with bridge boards: data cards for each duplicate bridge board, each data card having a series of individual data spaces for writing, in machine language, bridge scores obtained by each pair playing the corresponding board; each of said data spaces having lines divided into individual spots for optical reading thereof; said spots being printed in human recognizable symbols or numbers in the form of FIG. 11 incorporated in this claim by reference; the matter printed on said cards having an optical character different from the spots when encoded.

21. For use with a match point duplicate scoring system cooperable with a set of numbered bridge boards:

(a) a set of data cards for each board;

(b) each data card being divided into a series of at least fourteen spaces extending across the width of the card;

(c) one of the spaces being imprinted with machine invisible ink for encoding the identity both of the set of bridge boards and of the number of the board in the set;

(d) each of the other spaces being consecutively numbered corresponding to the round of play;

(e) each of said other spaces having a first area imprinted with machine invisible ink for player encoding of the bridge score obtained by the pairs playing the board on the designated round; and (f) each of said other spaces having a second area for placement in human readable form of the contract and result.

22. The set of data cards as set forth in claim 21 in which the first area has two rows of spots on centers for machine read, said spots being printed to read 10, 20, 30, 40, 50, 60, 70, 80, 90, 100, 200, 300, 400, 500, 600, 700, 800, 900, 1000, 2000, NS and EW.

23. The set of data cards as set forth in claim 22 in which the spots printed 100 to 900 inclusive are in one row, and the spots printed 10 to 90 are in another row.

* * * * *